United States Patent [19]

Rigter

[11] Patent Number: 4,599,762

[45] Date of Patent: Jul. 15, 1986

[54] PAINT APPLICATOR

[76] Inventor: Steven M. Rigter, 115 Townson Avenue, Palm Beach, 4221 Queensland, Australia

[21] Appl. No.: 611,465

[22] Filed: May 17, 1984

[51] Int. Cl.[4] ..... B05C 17/02
[52] U.S. Cl. ..... 15/248 A
[58] Field of Search ..... 15/248 A

[56] References Cited

U.S. PATENT DOCUMENTS

| | | | |
|---|---|---|---|
| 2,763,022 | 9/1956 | Glacken | 15/248 A |
| 3,213,477 | 10/1965 | Shafer | 15/248 A |
| 3,369,269 | 2/1968 | Deck et al. | 15/248 A |
| 3,623,180 | 11/1971 | Anderson | 15/248 A X |
| 3,685,084 | 8/1972 | Bennett | 15/248 A X |

FOREIGN PATENT DOCUMENTS

| | | | |
|---|---|---|---|
| 2439065 | 2/1975 | Fed. Rep. of Germany | 15/248 A |

*Primary Examiner*—Chris K. Moore
*Attorney, Agent, or Firm*—Jackson & Jones

[57] ABSTRACT

The invention provides a shielding device which may be mounted relative to a roller of a roller applicator for applying liquid to one surface of a pair of intersecting surfaces. The device functions to provide a continuous sharp cut in line at the intersection of the surfaces and includes shielding means, one edge of which forms a contact edge which in use touches the surface to which the liquid is applied and resilient mounting means for securing the shielding means to the roller whereby in use the roller may be pressed against the surface without disturbing the contact of the contact edge with the surface.

8 Claims, 15 Drawing Figures

PAINT APPLICATOR

BACKGROUND OF THE INVENTION

1. Field of the Invention

This invention relates to an apparatus for applying liquids to a surface.

While this invention has particular reference to applying paints it may be used for applying such liquids as process resins and the like. However, for brevity the invention will be described hereinafter with reference to painting.

2. Description of the Prior Art

Modern construction provides walls and ceilings having substantially flat surfaces whereby they can be easily painted using roller type paint applicators. However brush painting while relatively tedious is still used for cutting into corners between mating surfaces, such as between a wall and a ceiling, where a distinct paint junction line may be required. Roller applicators are generally unsuitable for so called "cutting in" applications, i.e., painting into corners, as the edge of the roller does not provide a sharp continuous paint line and paint on the roller is liable to be wiped onto the surface adjacent the surface being painted.

It is an object of this invention to provide an improved apparatus for applying liquids to a surface which allows for easy cutting in. Other objects and advantages of the present invention will hereinafter become apparent.

SUMMARY OF THE INVENTION

According to one aspect the invention provides a shield device mountable relative to a roller of a roller applicator for enabling the applicator to be used to apply a liquid to one surface of a pair of intersecting surfaces so as to provide a continuous sharp cut in line at the intersection of the surfaces, said device including shielding means, one edge of which forms a contact edge which, in use, touches the surface to which the liquid is applied and resilient mounting means for securing the shield to the roller, whereby, in use, the roller may be pressed against the surface without disturbing the contact of the contact edge with the surface.

In another aspect the invention provides a shielding device in combination with a roller applicator.

The mounting means is engageable within one end of the roller and may provide a bearing for a shaft fixed to said shield means whereby said mounting means may rotate about said shaft to provide for relative rotation between the roller and resilient mounting means. The shaft is resiliently fixed to said shielding means. It is also preferred that the shaft is disengageably mounted in said bearing and that retention means be provided to operatively hold the shaft in said bearing. The retention means may be a spring biassed mechanical retainer assembly or it may be a magnet supported in said mounting means to inhibit retraction of said shaft from said bearing, the shaft of course being formed of suitable material. Alternatively the mounting means could be secured to the fixed handle of the applicator. It is also preferred that the shield means is a plate like member having a linear surface contacting edge. The plate like member may be any suitable shape such as octagonal but preferably it is rectangular and supported symmetrically about said axle and substantially at right angles to the axis thereof.

In yet a further aspect this invention resides broadly in a roller type liquid applicator including an absorbent roller having mounting means at one end thereof for supporting a shielding device having shield means adapted to engage a surface on which liquid is to be applied to prevent spread of liquid beyond said shield means.

BRIEF DESCRIPTION OF THE DRAWINGS

In order that the invention may be more readily understood and put into practical effect, reference will now be made to the accompanying drawings which illustrate a preferred form of shield device and roller applicator made according to the present invention and wherein.

DETAILED DESCRIPTION OF THE PREFERRED EMBODIMENT

Figure 1:
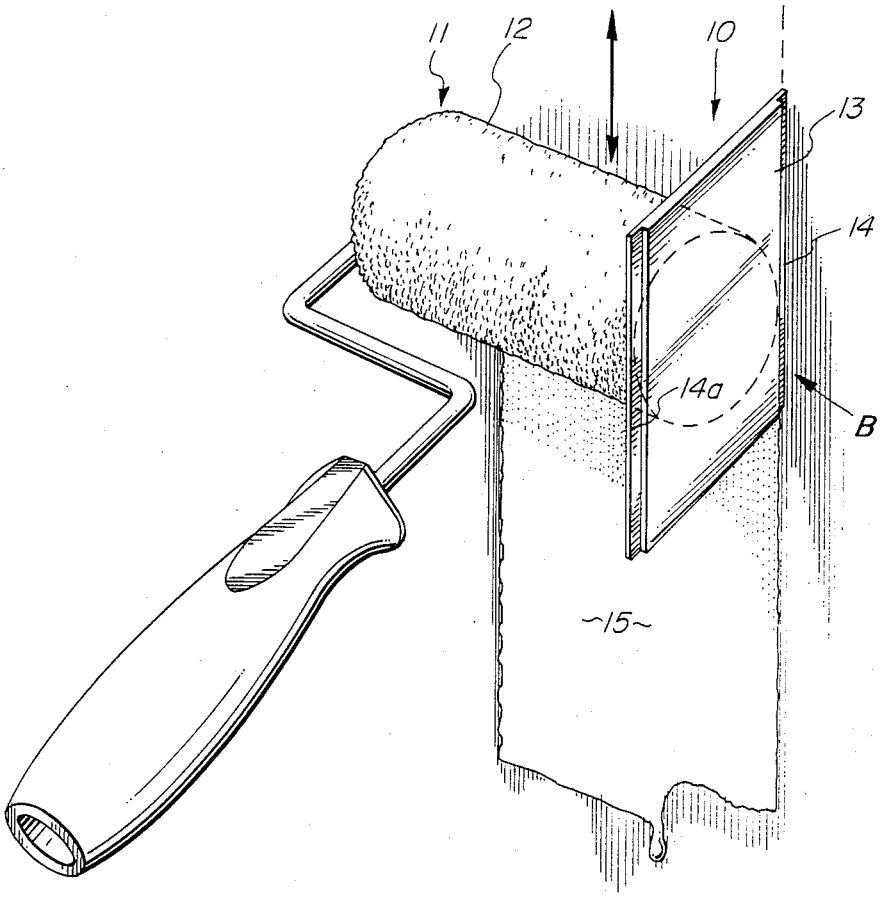
FIG. 1 is a perspective view illustrating the operation of the device.

Referring to the drawings it will be seen that the shield device 10 for the roller type paint applicator 11 is mounted at one end of the roller 12 whereby a plate-like shield means or plate 13 is supported in such manner that one edge 14 thereof is maintained in abutting relationship with the surface 15 being painted. This contact prevents paint spreading beyond the shield on the surface 15 and the shield plate 13 completely covers the end of the roller 12 to prevent paint thereon being transferred to an adjacent surface.

Figure 2:
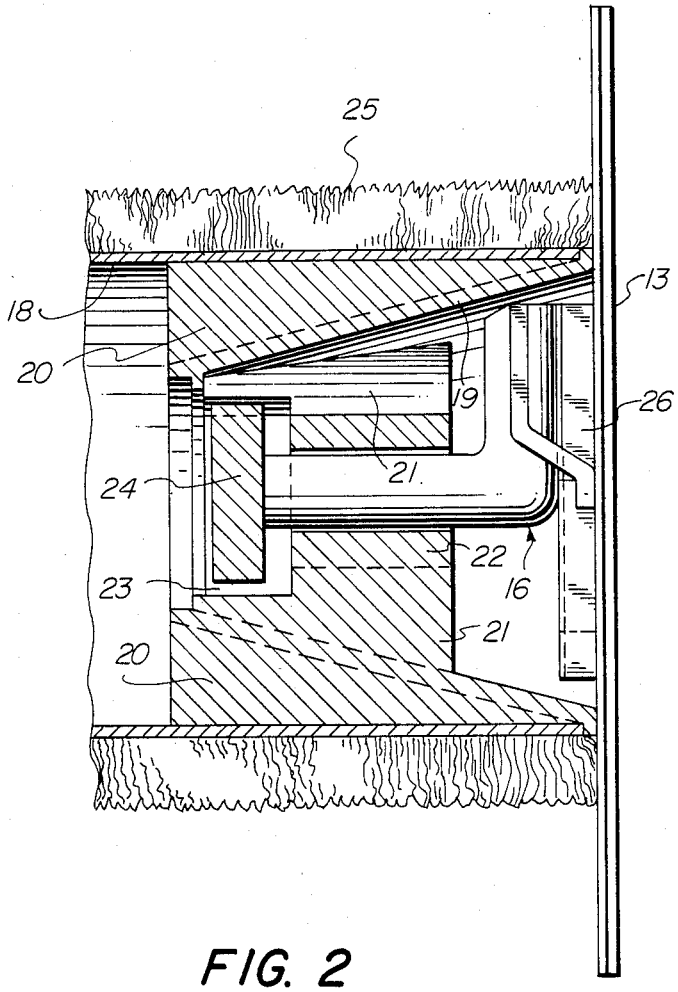
FIG. 2 is an enlarged cross-sectional view through the operative end portion of the device.
Figure 3D:
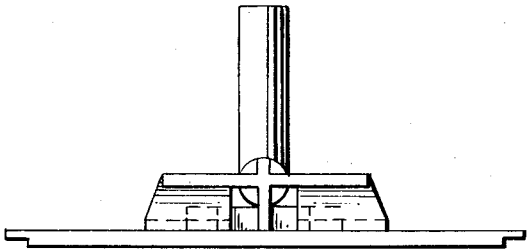
FIGS. 3A to D collectively illustrate the support axle for the shield means.
Figure 3B:
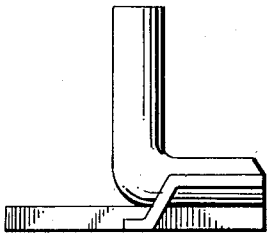
Figure 3C:
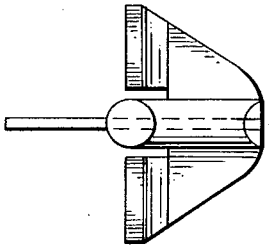
Figure 3A:
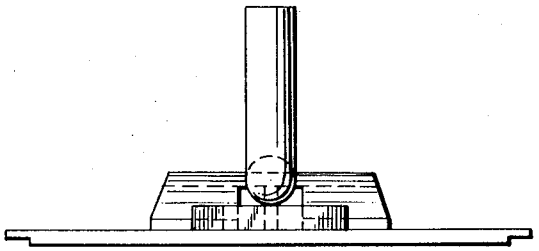
Figure 4:
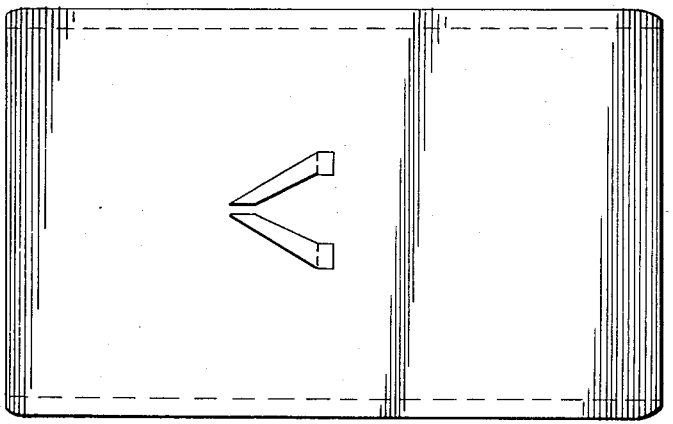
FIG. 4 illustrates the shield means.
Figure 6:
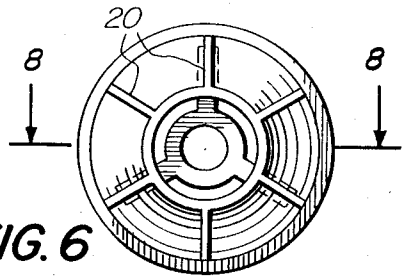
FIG. 6 is the opposite end view of the mounting insert.
Figure 5:
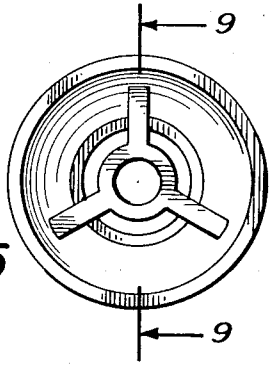
FIG. 5 is an end view of the mounting insert.
Figure 7:
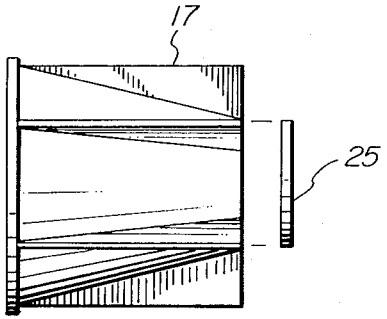
FIG. 7 is a side view of the mounting insert.
Figure 8:
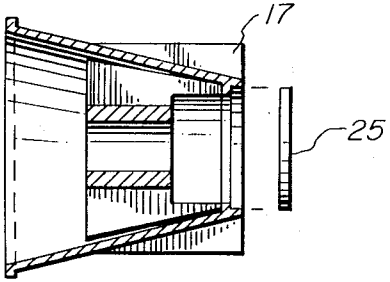
FIG. 8 is a cross-sectional view of along the line 8—8 of FIG. 6.
Figure 9:
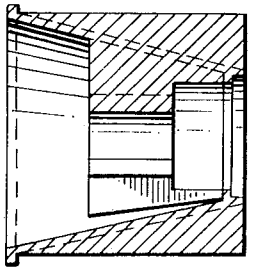
FIG. 9 is a cross-sectional end view along the line 9—9 of FIG. 5.

Referring initially to FIG. 2 it will be seen that the shield means or plate 13 is supported by an axle assembly 16 which engages rotatably in a mounting insert 17 secured into the bore 18 of the roller 12. This mounting insert 17 includes a frusto-conical housing 19 having six radially extending fins 20 on its outer surface for location within the bore 18 and three internal webs 21 which support the axle bearing 22. The fins 20 may be somewhat flexible to enable the insert to be fixed tightly in bores of various sizes. The frusto-conical housing 19 diverges outwardly to encourage paint which may find its way into the housing to flow back out on to the surface being painted. The housing 19 at its smaller end also provides an open cavity 23 for a magnet 24 which is retained in the cavity 23 by the clip-on end cap 25. The cavity 23 also opens into the base of the bearing 22 whereby the end of the axle 16*a*, which is formed of suitable steel, may extend into the cavity to engage the magnet 28 and thus be releasably retained in the bearing 22. It will be seen that the magnet may float in its cavity 23. When the axle 16*a* is secured in position by the magnet 24 it will be seen that the outer annular end of the insert 17 bears against the back face of the shield plate 13 to further stabilize same and ensure efficient operation of the assembly as well as ensuring that the inner edge portion of the contact edge 14 is closely adjacent the end of the roller 12.

Figure 10:
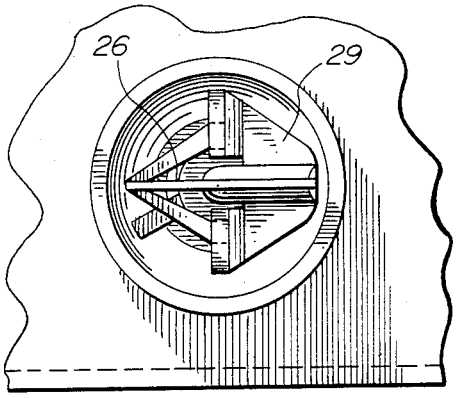
FIGS. 10 and 11 are end views in the direction B of FIG. 1.
Figure 11:
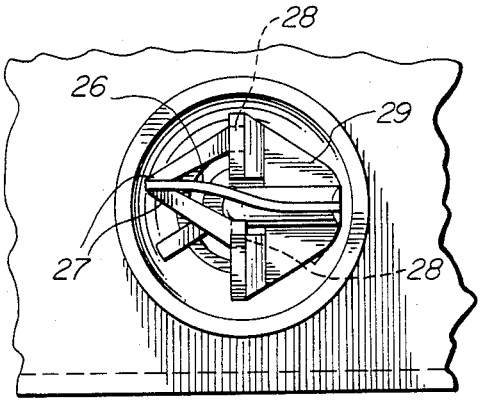

Since the engagement pressure between the roller 12 and the surface 15 will vary in use, the absorbent pad 25 will be compressed to varying degrees and the distance of the centre line of the roller with respect to the surface will vary. Accordingly the axle assembly 16 is resiliently fixed to the shield plate 13 by a leaf spring 26 which can flex in order to maintain the edge 14 of the shield plate 13 in contact with the surface 15 and bearing with sufficient pressure to prevent spreading of paint beyond the shield plate 13. The actuation of this leaf spring can be clearly seen in FIGS. 10 and 11. One end of the leaf spring 26 is held securely between the adjacent ends of fixed brackets 27 on the shield plate 13. These brackets 27 splay outwardly to provide retaining flanges 28 spaced from the shield plate 13 to accommodate the adjacent edge of a mounting plate 29, which is affixed to the axle assembly 16 and to the leaf spring 26.

The mounting plate 29, along with the axle **16*a* is restrained for relative movement with respect to the shield plate 13 in the one selected direction only, which corresponds to a direction substantially perpendicular to the edge 14 or 14*a* of the shield 13. This particular mounting arrangement is clearly illustrated in FIGS. 10 and 11**.

In use, the roller applicator 11 may be used without the shield device affixed in conventional manner to cover the clear areas to be painted. When the area to be painted adjoins a surface at right angles thereto and the paint line has to stop neatly along the junction of the surfaces, the shield device is simply clipped into place and painting continues with the shield plate covering the edge portion of the adjacent surface thereby preventing paint from being wiped onto the adjoining surface and at the same time a neat edging line will be formed coincident with the inner face of the contact edge 14. To reduce their thickness edges 14 and **14*a*** are cut-away or rebated as shown.

It will be seen that the resilience provided by the spring 26 maintains the contact edge 14 in firm contact with the wall even though the radius of the roller may vary. Also the same shield device can be used with different types of rollers having varying outer diameters. The shield plate may be formed of transparent plastic or of any suitable material as desired and of course the mounting insert may be made to suit different types of rollers. For a single roller type application the resilience required in the mounting of the shield may be less than described above or negligible and a soft or hard plastic may be utilized in the construction to provide the operative positioning of the shield relative to the roller.

Figure 12:
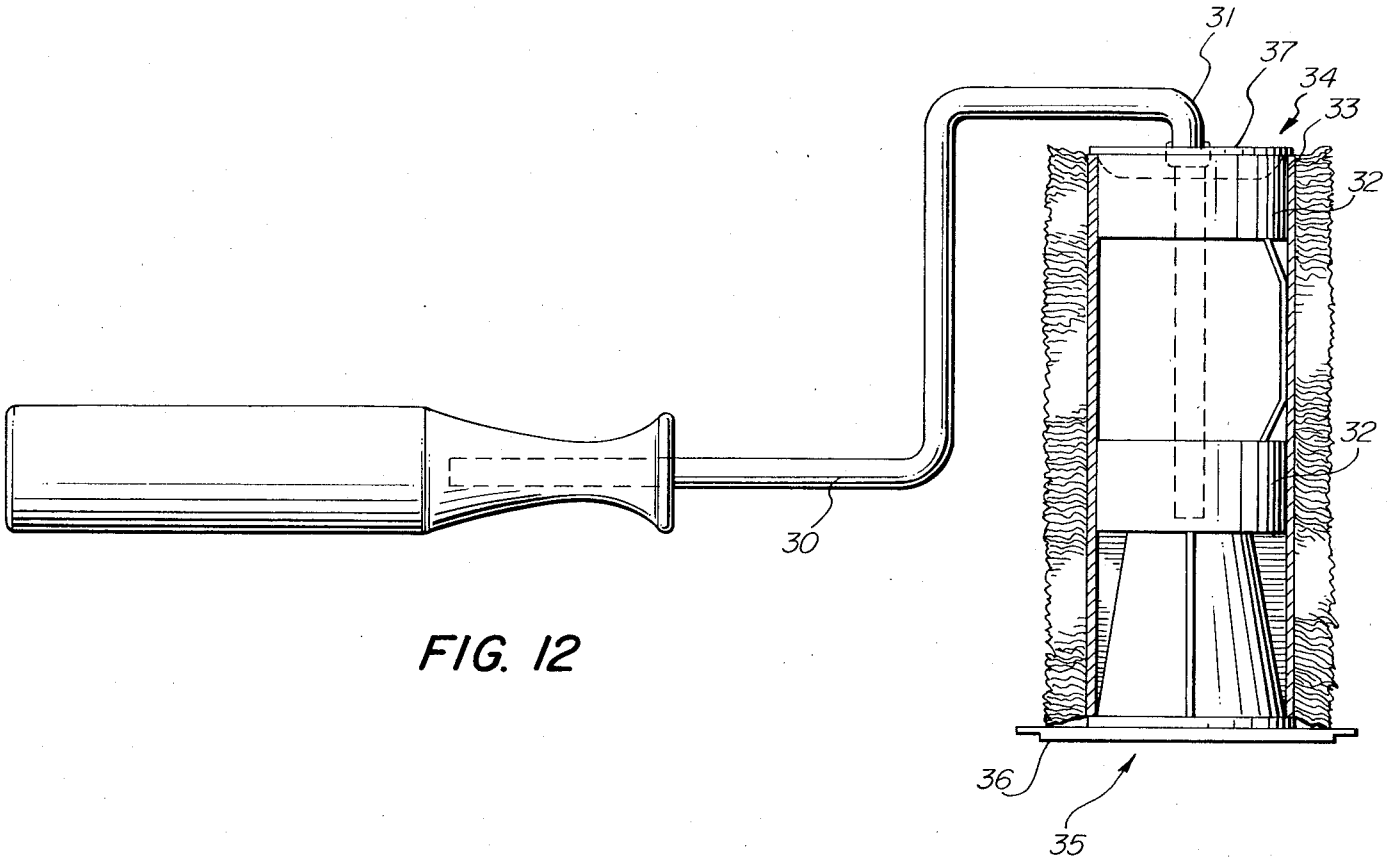
FIG. 12 is a partial cross-sectional view of a roller and a handle assembly.

A further feature of the present invention relates to a handle assembly which may be used for supporting different length rollers while at the same time providing space for attachment of the paint shielding assembly described above and correct support for both the applicator and the shielding assembly. A typical example of a handle assembly according to this invention is shown in FIG. 12. In this embodiment the handle 30 extends at right angles to the roller supporting axle 31 which is formed integrally therewith. The axle engages notatably in bearings 32 which push into the supporting cylinder 33 of the applicator 34. The elongate bearing assembly 35 so formed provides the necessary support for connecting the handle 30 to the applicator. The bearings 32 may be formed integrally or separately and are disposed adjacent to the supported end of the roller to leave the opposite end of the roller free to receive the shield device 35. In order that the force applied by the handle to the applicator 34 maintains contact between the shield 36 and the surface being painted the handle 30 is arranged in off-set relationship to the bearings 32 as illustrated so that the painting force is applied at a position spaced along the roller from the bearing 32 and remote from the supported end 37 of the applicator.

It will of course be realised that the above has been given by way of illustrated example only and all such modifications and variations as would be apparent to persons skilled in the art are deemed to fall within the broad scope and ambit of the present invention as is herein set forth.

From the drawings it will be seen that in one embodiment the roller receiving mounting secured to the handle of the applicator provides one bearing for the roller and the other bearing is provided by the insert which rotates relative to the shaft of the mounting means. In an alternative embodiment (not illustrated) the roller receiving mounting may be almost as long as the roller such that a small length of the roller projects over the free end of the receiving mounting. The resilient mounting means may thus fit directly into the free end of the roller. Thus no mounting insert is required. The resilient mounting may include a bearing to enable the roller to rotate relative to the resilient mounting.

What is claimed is:

1. A shield device mountable relative to a roller of a roller applicator for enabling the applicator to be used to apply a liquid to one surface of a pair of intersecting surfaces so as to provide a continuous sharp cut in line at the intersection of the surfaces, said device including shielding means, one edge of which forms a contact edge which, in use, touches the surface to which the liquid is applied, said contact edge has a rebate portion extending along it on the side of the shielding means opposite the roller, and resilient mounting means for securing the shielding means to the roller whereby in use the roller may be pressed against the one surface without disturbing the contact of the contact edge with the one surface.

2. The shield device of claim 1 wherein the shielding means is a rectangular plate and both of the longer edges of the shielding plate are rebated.

3. The shield device of claim 1 including a mounting insert receivable within one end of the roller and wherein said resilient mounting means has a portion receivable in and releasably held by the said mounting insert.

4. The shield device of claim 3 wherein said mounting insert includes a frusto-conical housing having radially extending inwardly directed fins, said fins being slightly flexible to ensure that said insert is a snug fit within the roller.

5. The shield device of claim 3 wherein said insert has a cavity for receiving a magnet for releasably holding said mounting means, said insert having a bore for receiving said portion of said mounting means.

6. The shield device of claim 1 wherein said mounting means includes an axle assembly resiliently fixed to said shielding means by a spring secured at one end to mounting bracket means attached to the shielding means and at its other end to a mounting plate, said mounting means being secured to the axle whereby during use the spring allows the mounting means to move relative to the mounting bracket means.

7. A shield device as defined in claim 1 and further comprising a roller applicator in combination with said shield device.

8. The combination of claim 1 wherein said roller applicator includes a handle and roller receiving mounting which provides a bearing on which the roller applicator may rotate.

* * * * *